United States Patent [19]

Lockard

[11] Patent Number: 4,681,382

[45] Date of Patent: Jul. 21, 1987

[54] ELECTRICAL CONNECTOR FOR TRANSMISSION CABLE

[75] Inventor: Joseph L. Lockard, Harrisburg, Pa.

[73] Assignee: AMP Incorporated, Harrisburg, Pa.

[21] Appl. No.: 811,965

[22] Filed: Dec. 20, 1985

[51] Int. Cl.[4] ..... H01R 4/66

[52] U.S. Cl. ..... 439/92; 29/860; 439/497

[58] Field of Search ..... 339/14 R, 17 F, 176 MF, 339/278 C; 29/800, 799

[56] References Cited

U.S. PATENT DOCUMENTS

| | | | |
|---|---|---|---|
| 2,183,109 | 1/1939 | Sipe . | |
| 3,038,958 | 6/1962 | Swengel . | |
| 3,878,318 | 4/1975 | Ziegler, Jr. et al. . | |
| 4,140,360 | 2/1979 | Huber | 339/176 MF |
| 4,160,573 | 7/1979 | Weisenburger | 339/176 MF X |
| 4,173,388 | 11/1979 | Brandeau . | |
| 4,225,208 | 9/1980 | Brandeau et al. . | |
| 4,252,397 | 2/1981 | Eigenbrode et al. . | |
| 4,260,209 | 4/1981 | Zell et al. | 339/14 R |
| 4,408,815 | 10/1983 | Apicelli et al. . | |
| 4,556,275 | 12/1985 | Hamsher | 339/14 R X |
| 4,579,404 | 4/1986 | Lockard . | |
| 4,596,428 | 6/1986 | Tengler . | |
| 4,600,259 | 7/1986 | Olsson . | |
| 4,602,831 | 7/1986 | Lockard . | |

FOREIGN PATENT DOCUMENTS 598937 1/1961 Belgium .

*Primary Examiner*—Eugene F. Desmond

*Attorney, Agent, or Firm*—Anton P. Ness

[57] ABSTRACT

A double row connector terminates transmission cable, with selected terminals for grounding to provide programming. Signal conductors are terminated to terminals in a housing by being held in interference fit in longitudinal slots of respective terminals and laser welded thereto. Ground conductors are similarly held in grooves of a ground bus in the housing and are laser welded thereto. Selected signal conductors are also laser welded to the ground bus as well as respective terminals to convert the terminals to grounds. The conductors are disposed in a termination plane transverse to the connector requiring right angle termination to the terminals. The insulated cable is then doubled back over a dielectric spacer secured to the housing over the terminations, and a retainer is latched to the housing to clamp the cable and provide strain relief. Terminals and a ground bus are specially designed for the connector and the laser welding termination method.

18 Claims, 10 Drawing Figures

Fig. 1
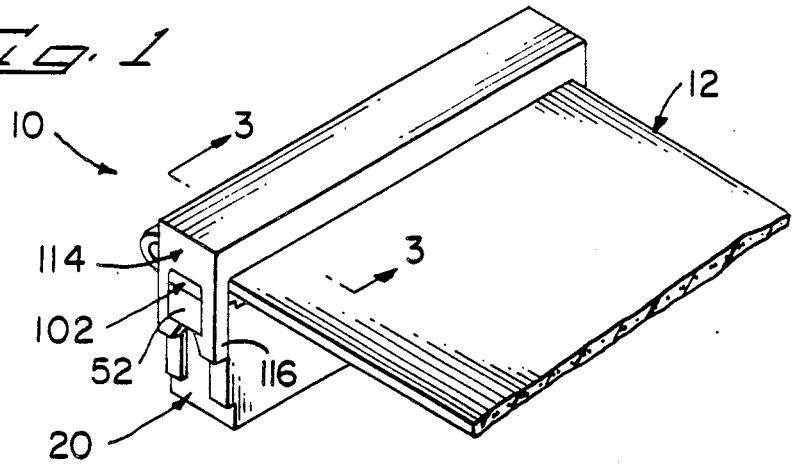
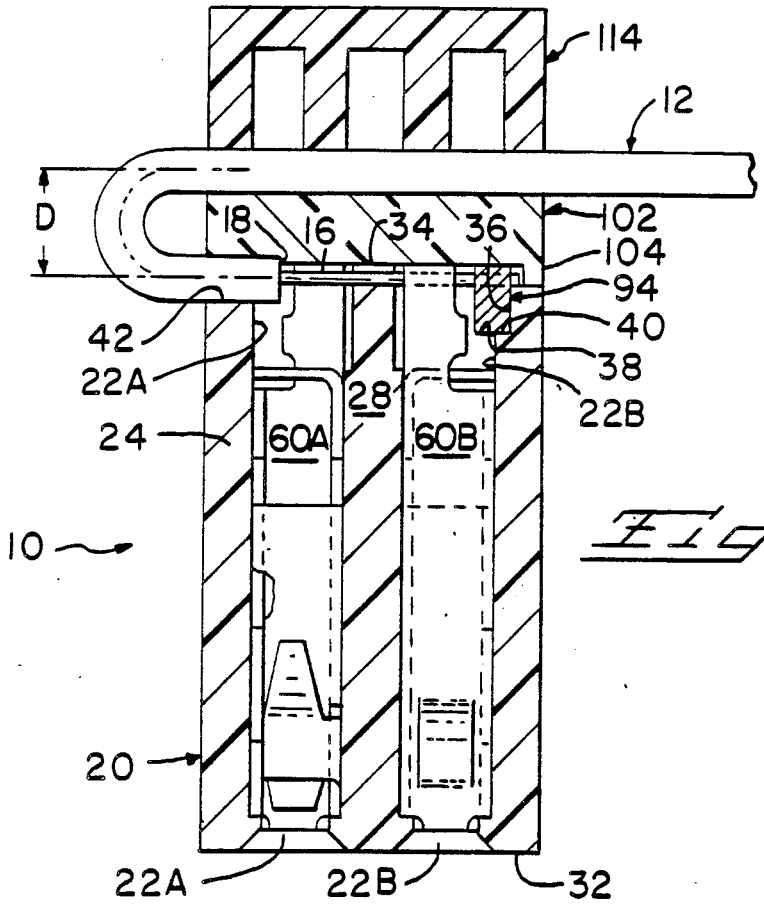
Fig. 3

ELECTRICAL CONNECTOR FOR TRANSMISSION CABLE

FIELD OF THE INVENTION

The present invention relates to the field of electrical connectors and more particularly to double row connectors for transmission cable.

BACKGROUND OF THE INVENTION

Double row receptacle connectors are known for flat transmission cable, which comprise a connector assembly for mating with a two-row pin array. Such connector assemblies route adjacent closely spaced signal conductors of the flat cable to terminals on alternating sides of the connector while routing the respective ground conductors to a ground bus contained in the connector.

U.S. Pat. No. 4,260,209 discloses such a connector for providing solderless mass termination of a flat transmission cable, where the receptacle terminals for the signal conductors have slotted beam termination sections and are terminated to the conductors by insulation displacement. Similarly the ground conductors are secured in slotted beams of the ground bus. The receptacle terminals and ground bus are disposed along respective recesses of a housing, the conductors of the cable are terminated thereto, a cover is placed over the terminations, and a strain relief member is secured to the assembly. The connector provides for selective programming of ground terminals by connecting selected receptacle terminals to the ground bus by grounding bars or by sacrificed signal conductors.

Transmission cable having small diameter conductor wire such as 0.013 inches or less has become the cable of choice for high speed signal transmission, whether it be multi-conductor flat ribbon cable or single conductor discrete cable. Although conventional slotted beam termination works well for conductor wire of larger diameter, it has proven to be difficult to obtain reliability with very small diameter conductors. In slot terminations, the electrical connection results from a gas tight interface between the slot beams and the wire because of spring force of the beams compressing the wire, and the ability of the wire to resist compression instead of flowing. With small wires, slot tolerance allowances must be very small which is practically very difficult to maintain. The forces in the compressed wires are also very small and so is the area of contact between the beams and the wire. There is considerable risk of nicking the wire. Handling and in-service mechanical vibration can disturb the termination joint. A further result of slotted beam termination is that the tines project upwardly beyond the wire, and the wire end must project beyond the slot, both of which result in increased crosstalk and reflection, or noise.

It is desired to provide a programmable double row connector for transmission cable having small diameter wires reliably and assuredly terminated to terminals.

It is further desired to provide a termination having a large area of connection, and one whose quality can be determined upon visual inspection.

It is also desired to provide a termination for small wires which will not deteriorate during handling and vibration.

It is even further desired to reduce and make more uniform the termination resistance of the terminated wires and to minimize crosstalk and reflection in the termination area.

And it is desirable to provide a termination means and a connector adapted thereto which can be incorporated into automated cable harness assembly.

SUMMARY OF THE INVENTION

The present invention is a double row receptacle connector for high speed signal transmission cable such as flat cable, for mating with a pin array, and is suitable for automated cable harness assembly. The connector includes a premolded forward housing member having two rows of terminal-receiving passageways extending rearwardly from a mating face thereof. Box-like receptacle terminals are disposed in the passageways, having contact sections at forward ends thereof and conductor-connecting sections at rearward ends thereof. A unique ground bus is disposed in the rearward end of the forward housing parallel to the two rows of terminals and has a profiled conductor-receiving surface with conductor-receiving recesses selectively spaced therealong. The unique conductor-connecting sections of the terminals comprise slots formed by spaced walls to receive respective conductors therealong in interference fit, and adapted not to damage the conductor wires. Together the conductor-receiving slots of the terminals and the conductor-receiving surface of the ground bus define a transverse termination plane wherein stripped end portions of the respective signal and associated ground conductors of the flat cable are disposed for right angle termination. Once disposed in the respective conductor-receiving slots the conductors are laser welded to form the terminations.

A dielectric spacer is latched to the forward housing rearwardly of the plane of termination which secures the ground bus, protects the terminations and provides a cable strain relief with the insulation jacket of the cable in clamping cooperation with the forward housing. The insulated cable extends outwardly from one side of the subassembly thus formed and is bent around a selected radius for 180° and doubles back over the rearward surface of the spacer to finally extend from the other side of the connector. A dielectric cable retainer is then latchingly secured to the subassembly over the cable to complete the connector assembly and provide substantial cable strain relief by clampingly securing the cable between the cover and the spacer.

The terminals are arranged in pairs in the two rows, but the conductor-receiving slots of terminals in one row are located at a side of the passageways opposed from that side at which are located the conductor-receiving slots of the terminals of the other row. Thus, the signal conductors terminated to those of the relatively far row extend past the conductor-receiving slots of the terminals of the near row laterally spaced therefrom. The ground conductors extend past the slots of both rows of terminals spaced laterally therefrom to reach grooves in the ground bus. The ground bus may be a profiled square wire which is electrically connected to selected receptacle terminals such as by sacrificed signal conductors of the cable which are not severed just past the termination thereof with a respective terminal but extend instead to the ground bus to be terminated thereto as well. In this manner the conductor is selectively programed, providing ground terminals at any desired locations.

BRIEF DESCRIPTION OF THE DRAWINGS

FIG. 1 is a perspective view of the assembled connector of the invention.

FIG. 3 is a longitudinal section view of the connector taken along lines 3—3 of FIG. 1.

DETAILED DESCRIPTION OF THE PREFERRED EMBODIMENT

Figure 2:
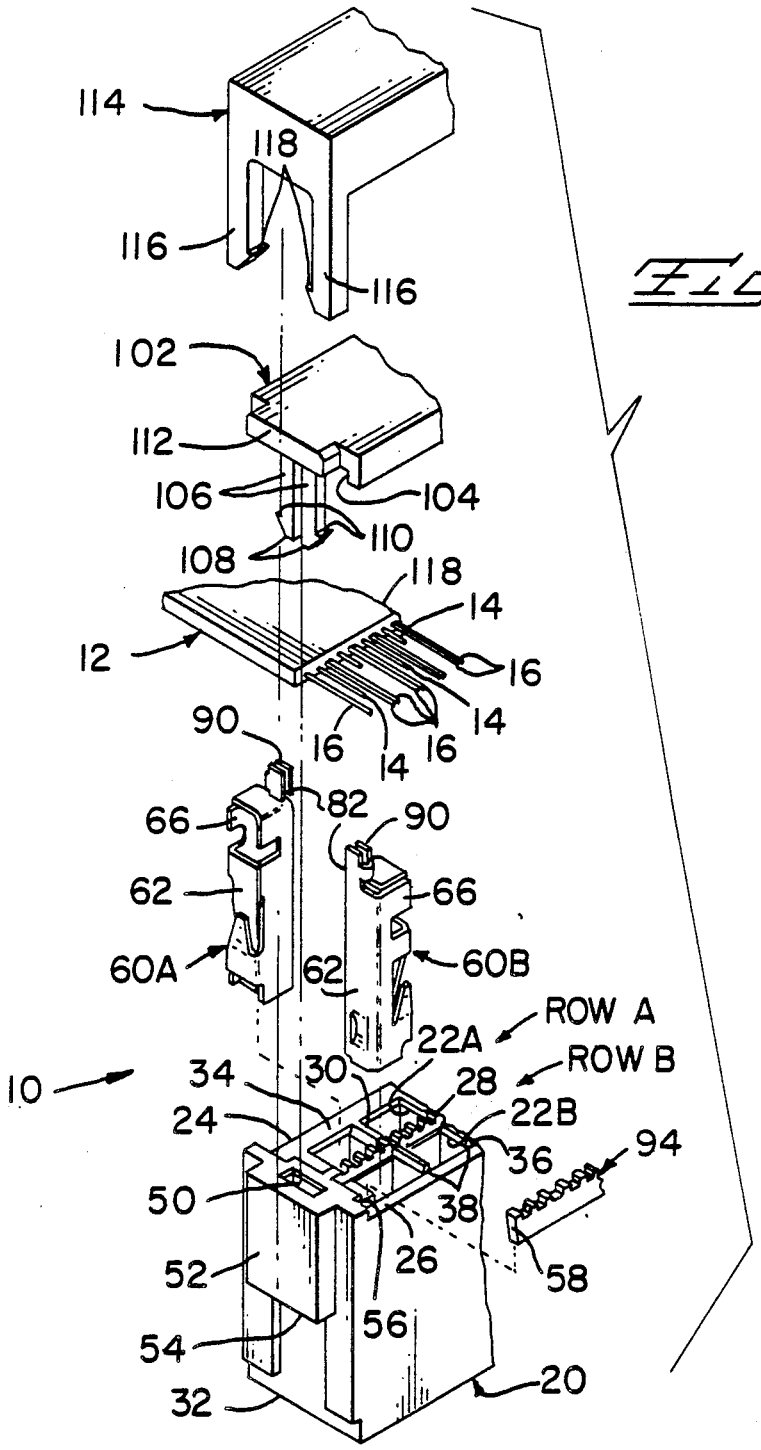
FIG. 2 is an exploded view of part of the connector.

The conductor assembly 10 is shown in FIG. 1, having a dielectric housing member 20, a dielectric spacer 102, and a dielectric cable retainer 114, all premolded of sturdy thermoplastic resin such as polyetherimide. Flat transmission cable 12 first extends outwardly from one side of connector 10, then bends around a 180° turn and extends through connector 10 to finally extend at a right angle from the other side, secured to connector 10 by retainer 114 latched by latch posts 116 to latching flanges 52 of housing 20.

In FIG. 2 housing 20 has two rows A, B of paired terminal-receiving passageways 22A,22B spaced therealong defined by parallel outer walls 24,26, a central inner wall 28, and spaced crossing walls 30, and extending from a mating face 32 to a rearward termination face 34. A respective receptacle terminal 60A,60B is secured into each passageway 22A,22B. Lead-ins are provided at the rearward ends of passageways 22A,22B to assist in automated insertion of respective terminals 60A,60B thereinto, and the forward ends of passageways 22A,22B are also preferably formed with lead-ins to receive posts or pins thereinto during mating. Along the inside of outer wall 26 is a bus-receiving channel 36 defined by aligned recesses 38 in the crossing walls 30 and a ledge 40 along outer wall 26, more clearly shown in FIG. 3. Ground bus 94 is disposed along channel 36. Cable 12 is prepared for termination and placed along termination face 34 for termination. After termination, spacer 102 is secured thereover by being latched by latching arms 106 to housing 20. When cable 12 is then bent over the top surface of spacer 102, retainer 114 is then latchingly secured to housing 20 to complete the assembly.

Flat transmission cable 12 conventionally comprises a plurality of signal conductors 14 on either side of each of which is disposed a ground conductor 16 spaced a selected distance therefrom. A thick flat insulative jacket 18 embeds all the conductors 14,16 therein by typically being extruded thereover. An end portion of cable 12 is prepared by slitting jacket 18 such as by use of a conventional $CO_2$ laser and sliding the severed jacket portion forwardly exposing the signal and ground conductors 14,16.

Figure 4:
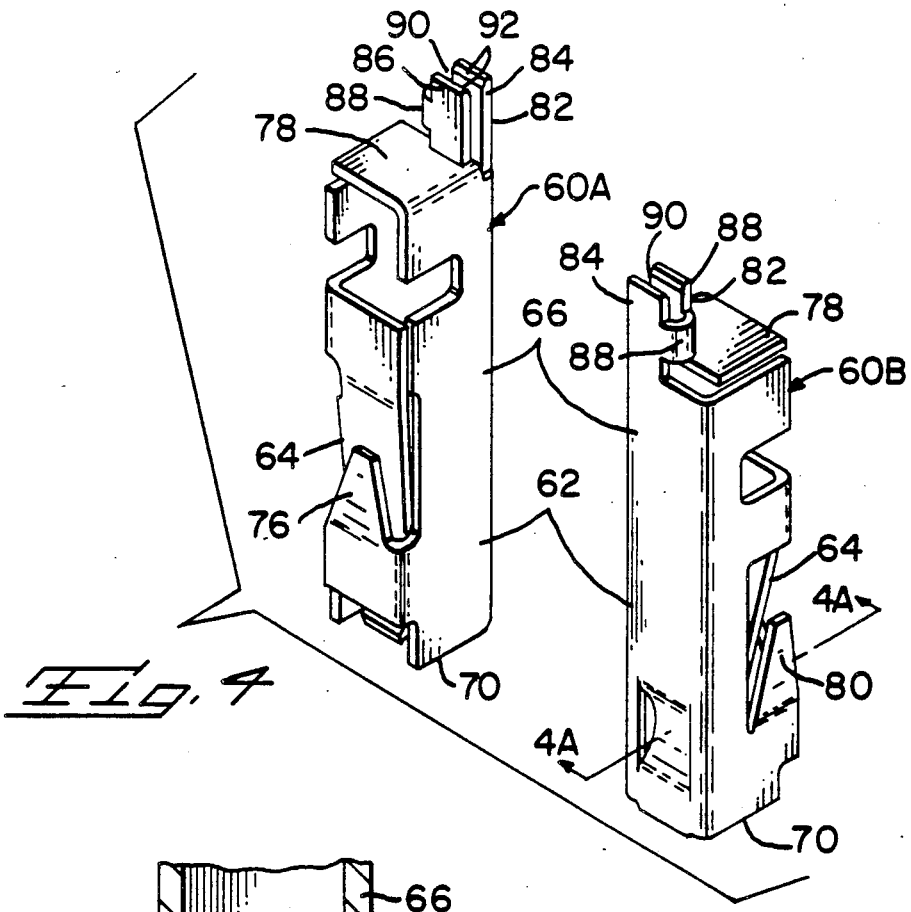
FIG. 4 is a perspective view of a pair of terminals showing their opposed angular orientation.
Figure 4A:
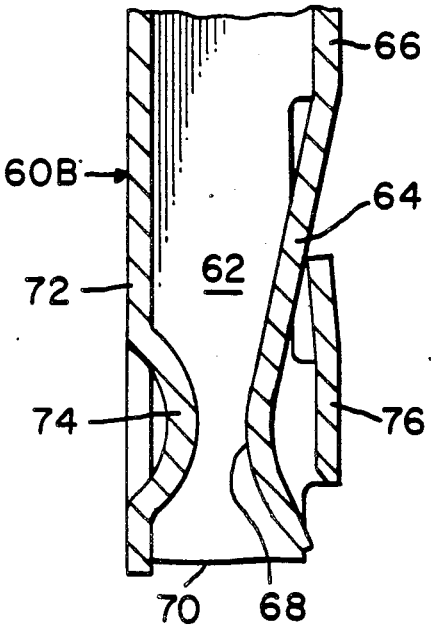
FIG. 4A is a part section view of the forward end of a terminal.

Receptacle terminals 60A,60B are identical to each other but are oriented in angular opposition when secured in respective passageways 22A,22B. Referring to FIGS. 3, 4 and 4A, each terminal 60A,60B is stamped and formed preferably from a sheet of phosphor bronze plated with gold over nickel, into a box-like receptacle body 62. A spring contact arm 64 extends forwardly in cantilever fashion from one wall of rearward body portion 66 angling inwardly to a contact section 68 proximate the forward end 70 of body 62, and curving arcuately outward to form a lead-in for receipt of a pin of a pin array (not shown) during mating. On sidewall 72 opposed from contact section 68 of spring contact arm 64, is formed an arcuate inward projection comprising a cooperating contact section 74. An assist spring 76 extends behind spring contact arm 64 as a tab from a lateral edge of an adjacent sidewall of receptacle body 62 proximate forward end 70. At the rearward end of rearward body portion 66 is a transverse tab 78 extending inwardly from one side wall to form a pin stop. Preferably one side wall of receptacle body 62 contains a lance 80 extending at a slight angle outwardly and rearwardly such that lance 80 engages a sidewall of the respective passageway 22A,22B under spring tension to assist in holding the terminal in the passageway prior to completed assembly of connector 10.

Figure 7:
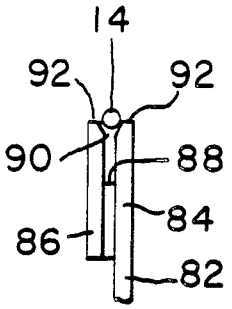
FIGS. 7 and 8 illustrate the fitting of a signal conductor into a terminal slot to be terminated.
Figure 8:
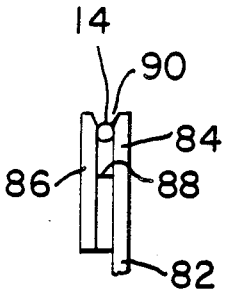
Figure 9:
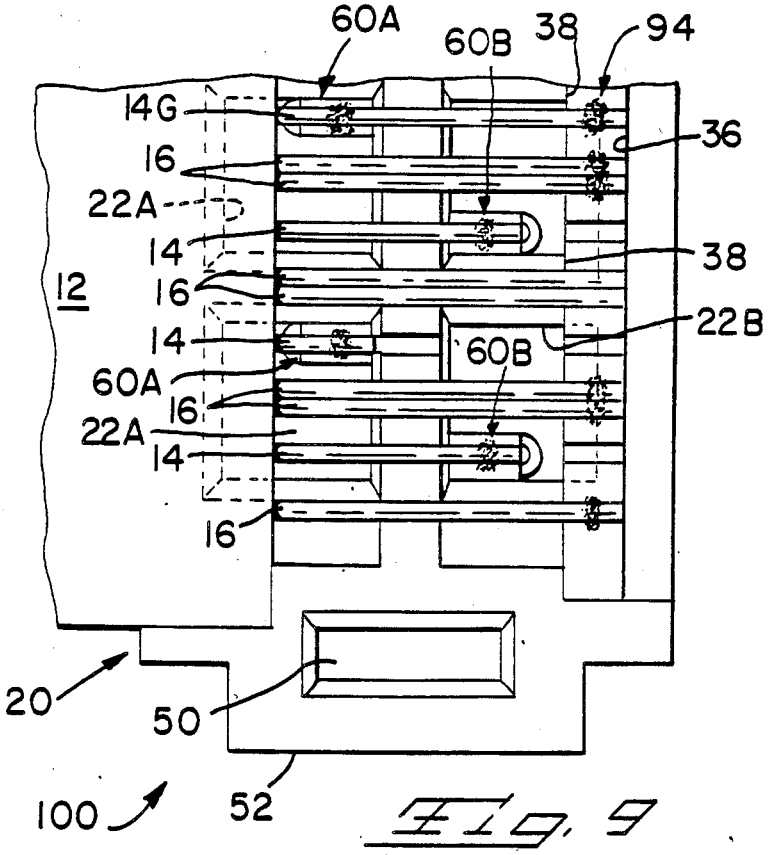
FIG. 9 is a top view of the terminal subassembly with signal and ground conductors laser welded to respective signal terminals and the ground bus.

Each terminal 60A,60B has a conductor-connecting section 82 extending rearwardly from rearward body portion 66 comprising a planar first plate 84 integral with receptacle body 62, a planar second plate 86 parallel to first plate 84, and a bight 88 joined to lateral edges of both first plate 84 and second plate 86. Second plate 86 is spaced from first plate 84 a distance selected to be just less than the diameter of a signal conductor 14 of cable 12 forming a conductor-receiving slot 90. Rearward edges 92 of first plate 84 and second plate 86 are coined or swaged, forming a bevel along slot 90 to provide a lead-in along slot 90 so that a signal conductor 14 may be wiped thereinto to be held in interference fit between smooth facing surfaces of first plate 84 and second plate 86 near the top of slot 90 (as seen in FIGS. 7 and 8) without sharp edges extending into the slot which could damage the small diameter conductor wire. Second plate 86 can be urged away from first plate 84 by conductor 14, by reason of bight 88 having spring characteristics. Bight 88 does not extend to rearward edges 92 but is spaced therefrom, which permits a conductor 14 in slot 90 to extend past bight 88 into slot 90 of a terminal 60B, or to extend past conductor-connecting section 82 of a terminal 60A to ground bus 94, if desired, such as conductor 14G as seen in FIG. 9.

All the terminals in one row are of the same angular orientation, while all the terminals in the other row are of the opposite angular orientation. In this way all slots 90 of terminals 60A in row A are disposed along a common side of respective passageways 22A, while all slots 90 of terminals 60B in row B are disposed along a common opposite side of respective passageways 22B, the importance of which will soon become apparent.

Figure 5:
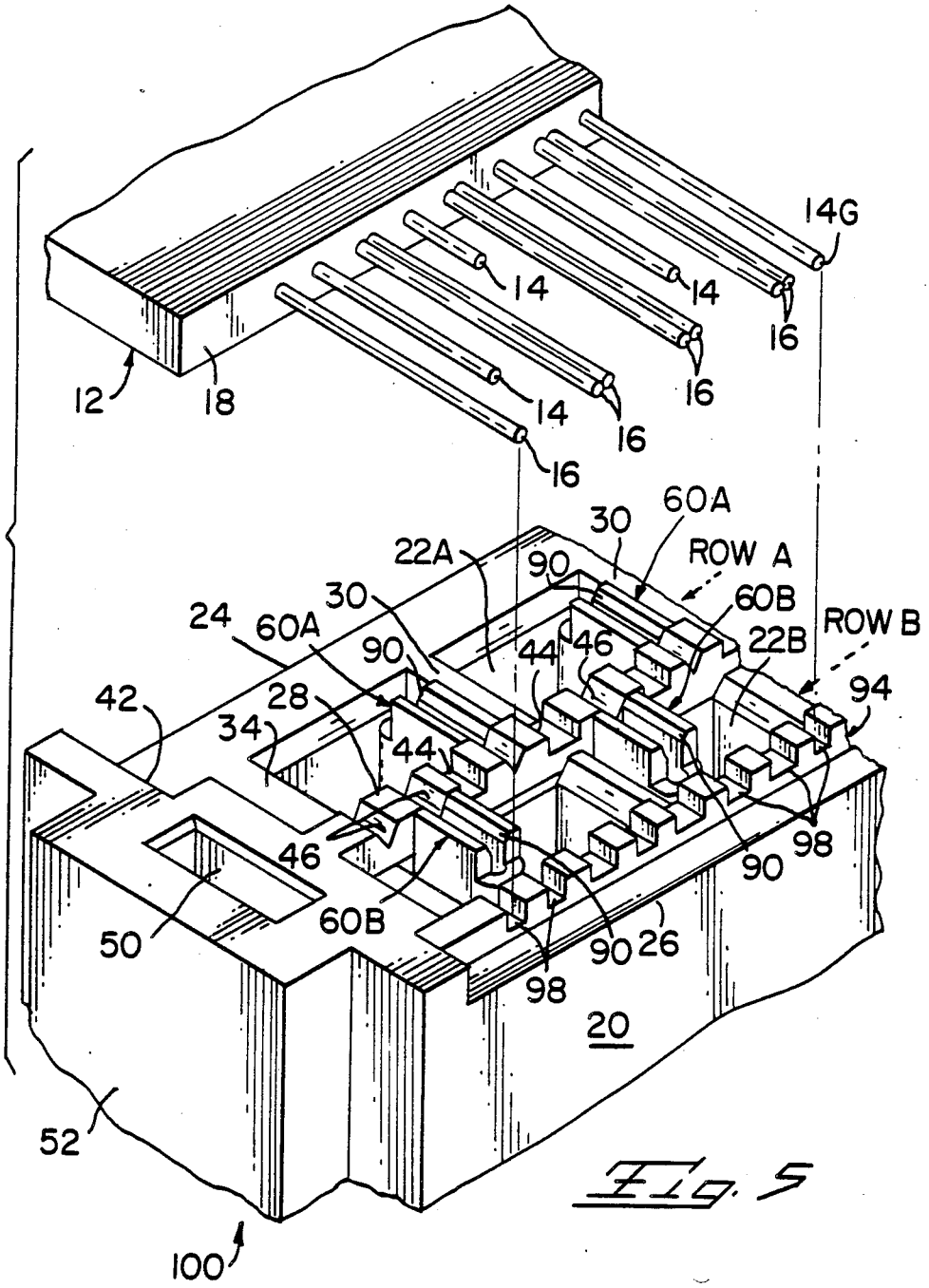
FIGS. 5 and 6 are perspective views of part of the terminal assembly with a prepared cable end portion exploded therefrom and in engagement therewith for termination, respectively.

In FIG. 5, ground bus 94 has a profiled termination surface 96 extending rearwardly from the termination face 34 of housing 20. Profiled surface 96 has a plurality of spaced grooves 98 thereacross of selected widths capable of receiving in interference fit single or paired ground conductors 16 of cable 12 and each signal conductor 14, if desired and having a depth about equal to the diameter of a conductor wire. Ground bus 94 can be a wire of rectangular cross-section as shown in FIG. 3, of preferably copper nickel alloy, and grooves 98 can be formed therein by precision grinding or preferably by broaching.

Lateral ends 58 are preferably tapered to assist in automated insertion of ground bus 94 into bus-receiving channel 36. Because channel 36 is preferred to be larger than ground bus 94 for insertion purposes, the precise aligning of grooves 98 is accomplished by centering ground bus 94 laterally through the use of small-dimensioned deformable vertical ribs 56 at each end of channel 36 of housing 20. During insertion as tapered ends 58 begin to engage ribs 56, the small-dimensioned ribs 56 are deformed by ground bus 94 and thus provide an interference fit which takes up tolerance.

Central wall 28 of housing 20 has a plurality of channels 44 formed thereacross corresponding to locations of all the signal and ground conductors 14,16 of cable 12, and having a width capable of receiving therein the respective signal conductors 14 or respective ones or pairs of ground conductors 16 as appropriate. Ones of channels 44 for single conductors may be V-shaped grooves 46. Crossing walls 30 are disposed at a level below channels 44. Channels 44 and V-shaped grooves 46 of central wall 28 are thus in alignment with grooves 98 of ground bus 94. V-shaped grooves 46, it can be seen, are also aligned with adjacent conductor-receiving slots 90 of respective ones of terminals 60A,60B.

Figure 6:
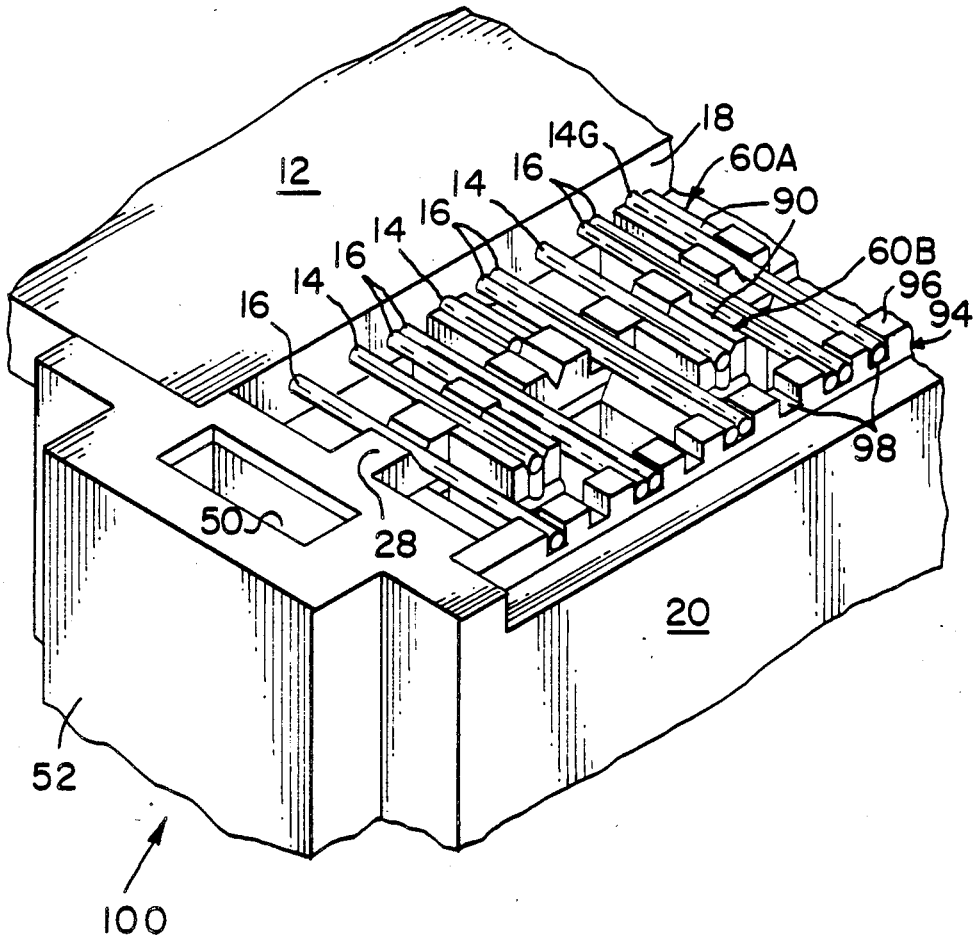

With reference to FIGS. 5 and 6, the prepared cable end is to be placed atop the terminal subassembly 100 with the end portion of the cable jacket 18 adjacent cable-receiving recess 42 of outer wall 24, termed hereinafter the near wall 24, and proximate the near row A of terminals 60A. Outer wall 26 is thus the far wall 26 and the second row of terminals 60B is the far row B. The signal and ground conductors are first selectively severed.

Signal conductors 14 to be terminated to those terminals 60A in the near row A which are desired to be signal terminal locations, are severed to a length just enough to extend through respective conductor-receiving slots 90. Signal conductors 14 to be terminated to those terminals 60B in the far row B which are desired to be signal terminal locations, are similarly severed to a length just enough to extend through respective slots 90. Ground conductors 16 are all of a length appropriate to extend to ground bus 94 to be received in grooves 98 thereof for termination.

An important feature of the present invention is that the conductor-receiving slots 90 of terminals 60A,60B, the conductor-receiving grooves 98 of the ground bus 94, and the channels 44 and V-shaped grooves 46 across central wall 28, all be disposed in a common plane, or plane of termination along termination face 34 of housing 20. In this way the signal conductors 14 remain substantially undeformed by remaining unbent and in the same plane as the ground conductors 16 to assist in impedance control.

FIG. 6 shows signal conductors 14 disposed in respective slots 90 for termination, and ground conductors 16 disposed in respective grooves 98 of ground bus 94 for termination. In FIGS. 7 and 8, signal conductors 14 have been carefully wiped into respective slots 90 to be held in interference fit therein near the top of the slots. The terminal subassembly 100 thus formed is ready for the signal and ground conductors 14,16 to be laser welded to terminals 60A,60B and ground bus 94 respectively for termination. FIG. 9 shows terminal subassembly 100 after the laser welding termination process has been performed.

The ground bus 94 is electrically connected to one or more of terminals 60A,60B selected to be ground terminals by being terminated to an appropriate one or more sacrificed signal conductors 14G, as seen in FIGS. 5, 6 and 9. Such a sacrificed signal conductor 14G is severed to the same length as the ground conductors and is terminated both to the ground bus 94 and its respective receptacle terminal 60A,60B.

Following termination, as seen in FIGS. 1 and 2, spacer 102 is secured on top of the terminated subassembly 100 and against the profiled surface 96 of ground bus 94. The bottom surface of spacer 102 is disposed against the top surfaces of central wall 28 providing substantial electrical isolation between terminations of adjacent signal conductors 14. Spacer 102 has a rib 104 extending along the far side of housing 20 and held firmly against the top surface 48 of far wall 26. Spacer 102 also clamps the insulated end of cable 12 with cable-receiving recess 42 of near wall 24. A pair of latch arms 106 proximate each end of spacer 102 extend into a respective latching cavity 50 extending through latching flange 52 at each end of housing 20, and latch arms 106 are urged slightly together during placement of spacer 102 on housing 20, and their ends 108 have latching surfaces 110 which engage forward end surfaces 54 of the latching flange 52 when latch arms 106 resile after completing their passage through latching cavity 50. Spacer 102 has end sections 112 extending beyond latch arms 106 and over the top surfaces of flanges 52 of housing 20.

Cable 12 is then folded back over spacer 102 as seen in FIG. 3 until it is parallel to the termination plane and spaced a distance D equal to at least about two cable thicknesses between the centers of the cable portions. It is preferable not to bend the cable about a radius more sharply than the one described.

Retainer 114 is then secured to the assembly thus formed. A pair of latch posts 116 at each end of retainer 114 have latching surfaces 118 at ends thereof which extend past an end section 112 and latch over a respective latching flange 52 of housing 20, and retainer 114 engages against end sections 112 of spacer 102 and firmly secures cable 12 to the connector assembly 10 and provides cable strain relief.

A method of terminating conductors by laser welding is generally described in U.S. patent applications Ser. Nos. 769,552 filed Aug. 26, 1985 and 652,778 filed Sept. 19, 1984 and assigned to the assignee hereof. The present invention includes a method of laser welding for right-angle termination, where the conductor is disposed at right angles to the axis of the terminal. The laser welded joints are as strong as the wire, the electrical connection to the terminal is about as large as the wire diameter, and the connection will not deteriorate in vibration. The preparation of the cable end, the wiping of conductors into slots and the laser welding by precise computer control are easily incorporated into an automated cable harness assembly. The resistance of the welded wires at their terminations is smaller and more uniform than that of slot terminated wires. The elimination of tine projections from the terminals, and the elimination of wire ends extending beyond the terminals, eliminates geometry which is known to act as antennae, and thus substantially lessens reflection and crosstalk.

The present invention also includes a unique ground bus suitable for the connector and method of the present invention, and also unique conductor-connecting terminal sections.

Housing 20 of the connector may easily be adapted to accommodate different diameters of conductor wires by simply varying the width of channels 44,46 of the central wall 28, grooves 98 of ground bus 94, and slots 90 of terminals 18.

The connector of the present invention may easily be adapted for use with individual transmission cables by providing suitable strain relief therefor and appropriate cable spacing.

Other variations may be made as required in the present invention such as latching means or the structure of the contact sections of the terminals within the spirit of the invention and the scope of the claims.

What is claimed is:

1. An electrical connector for electrical transmission cable means having signal conductor means and ground conductor means, comprising:

a housing means having at least one row of terminal-receiving passageways extending from a mating face to a termination face;

contact terminals disposed in said terminal-receiving passageways, each said terminal having a contact section means proximate said housing mating face and a conductor-connecting section proximate said housing termination face;

a ground bus secured in a bus-receiving channel of said housing means in interference fit therein along said housing termination face parallel to said at least one row of terminal-receiving passageways, said ground bus having means for connecting with ground conductor means;

means for grounding said ground bus; and cable-securing means to secure and provide strain relief for an end portion of the transmission cable means and protect the terminations following termination of the signal conductor means to respective said contact terminals and of the ground conductor means to said ground bus.

2. An electrical connector as set forth in claim 1 wherein said bus-receiving channel is generally dimensioned slightly larger than said ground bus and has deformable ribs at the ends thereof which first engage tapered surfaces at respective ends of said ground bus to center said ground bus in said bus-receiving channel and then are deformed thereby, whereby automated insertion of said ground bus into said housing means is assisted.

3. An electrical connector for electrical transmission cable means having a signal and ground conductor means, comprising:

a housing means having a mating face and extending to a substantially planar terminating face, at least one row of terminal-receiving passageways therethrough, and a first side and an opposing second side;

contact terminals disposed in respective said terminal-receiving passageways, each said terminal having a contact section means proximate said housing mating face and a conductor-connecting section proximate said housing termination face;

a ground bus secured to said housing means along said housing termination face along said second housing side and having conductor-connecting means across a top surface thereof, and means for grounding said ground bus;

cover means appliable to said termination face of said housing means following termination of stripped end lengths of signal conductor means and ground conductor means of transmission cable means to said contact terminals and ground bus respectively; and cable-securing means to secure and provide strain relief for an insulated end portion of the cable means from which said stripped end lengths of said signal and ground conductor means extend, following termination and covering of the terminations;

a portion of said first housing side being recessed below said termination face a selected distance to comprise a cable-receiving recess so that upon receipt of said insulated cable end portion thereinto said stripped conductor ends extend forwardly in a planar array along and substantially coplanar with said termination face;

said conductor-connecting sections of said contact terminals each comprising an elongated slot defined by smooth planar surfaces of a pair of opposing plates of a respective said terminal spaced apart a distance just less than the diameter of a said signal conductor means and adapted to receive thereinto and be urged apart by a respective said signal conductor means substantially without deformation thereof, to hold the signal conductor means therewithin at the top of said slot under spring tension prior to said laser weld termination, said slots being normal to said first housing side and spaced from each other to correspond with the spacing of said signal conductor means, and the tops of said slots comprising the uppermost extent of said contact terminals; and said conductor-connecting means of said ground bus comprising at least first grooves normal to said first housing side and spaced to correspond with the spacing of ground conductor means of the cable means, said first grooves being shaped and dimensioned to receive thereinto and thereafter to hold in interference fit therein until said laser weld termination said ground conductor means substantially without deformation thereto along the top surface thereof;

whereby said signal and ground conductor means are held in said contact terminals and ground bus respectively in the plane of said termination face, and said housing means with said contact terminals and ground bus disposed therein being essentially free of connector structure above said termination face to facilitate laser weld termination of said signal and ground conductor means to said contact terminals and ground bus respectively and to protect the integrity of the signal transmission during in-service use.

4. An electrical connector as set forth in claim 3 wherein said housing means comprises two rows of terminal-receiving passageways having respective said contact-terminals therein, and the conductor-connecting sections of the contact terminals disposed in a first one of said two rows of passageways alternate with the conductor-connecting sections of the contact terminals disposed in the second one of said two rows of passageways to be terminated to respective alternating ones of said signal conductor means extending from said insulated cable end portion along said termination face of said housing means.

5. An electrical connector as set forth in claim 4 wherein a wall between said two passageway rows includes channel means thereacross to receive therealong respective said signal and ground conductor means.

6. An electrical connector as set forth in claim 5 further comprising a dielectric spacer means securable to said housing means over the terminations of said signal and ground conductor means to respective said contact terminals and said ground bus respectively, said dielectric spacer means having a bottom surface disposed against a top surface of said wall whereby said signal and ground conductor means extending across said wall are closely surrounded by said spacer bottom surface and said wall channel means.

7. An electrical connector as set forth in claim 6 wherein said spacer means has pairs of latch posts at opposite ends thereof latchably securable in corresponding latching cavities at ends of said housing means proximate the mating face thereof, and clamping the end portion of the insulative jacket of said transmission cable means between said spacer means and said housing means.

8. An electrical connector as set forth in claim 7 further comprising a retainer means securable to said housing means over a second portion of said transmission cable means bent back over the top surface of said spacer means thereby providing clamping securement of said transmission cable means to said housing means.

9. An electrical connector as set forth in claim 8 wherein said retainer means includes pairs of latch posts at opposite ends thereof latchably securable over corresponding latching flanges at ends of said housing means proximate the mating face thereof.

10. An electrical connector as set forth in claim 3 wherein said ground bus includes a plurality of second grooves across said top surface thereof positioned to receive selected ones of said signal conductor means therein and having widths slightly less than the widths of respective said selected signal conductor means whereby said selected signal conductor means are held therein in interference fit for weld termination.

11. An electrical connector as set forth in claim 10 wherein said means for grounding said ground bus comprises said selected ones of said signal conductor means each terminated both to said ground bus and to a respective said contact terminal and thereby forming a ground terminal, whereby said connector is programmed.

12. A contact terminal for termination to a stripped end portion of an electrical conductor having a very small diameter, said contact terminal comprising a body section means including a contact section, and a conductor-connecting section extending rearwardly from said body section means, said conductor-connector section comprising a first plate jointed integrally to said body section means, a second plate parallel to and spaced from said first plate a selected distance forming an elongated conductor-receiving slot therebetween having a width slightly less than the diameter of a said conductor to be inserted thereinto for termination thereto, said slot defined by smooth facing surfaces of said first and second plates, and a U-shaped resilient bight extending from said first plate to said second plate and integrally joined to side edges of said first and second plates remote from end edges thereof, and said bight having such resilience as to permit said plates to be urged apart by the electrical conductor, whereby the electrical conductor is substantially undeformed when wiped thereinto and is then held under spring tension near the top of said slot for later assured termination thereto.

13. A contact terminal as set forth in claim 12 wherein said end edges of said first and second plates are coined along said slot to provide a longitudinal lead-in for said conductor.

14. A contact terminal as set forth in claim 12 wherein said first and second plates are disposed parallel to the axis of said body section, said side edges thereof joined by said resilient bight are parallel to said axis, and said end edges thereof are transverse to said axis, said slot thereby being transverse to said axis of said body section for right angle conductor termination.

15. A method of forming a transmission cable harness having an electrical connector terminated to at least one end of a transmission cable means having a plurality of signal and ground conductor means at right angles thereto, comprising the steps of:

stripping the insulative jacket from an end portion of a transmission cable means exposing said plurality of signal and ground conductor means thereof for termination;

selectively severing said signal and ground conductor means to desired lengths;

selecting a plurality of terminals corresponding to the number of said signal conductor means, each of said terminals including a conductor-receiving slot at an end thereof transverse thereto having a width selected to be slightly less than the diameter of a said signal conductor means defined by opposing smooth surfaces of walls adapted to be urged apart by a said signal conductor means wiped thereinto;

preparing a terminal subassembly having a termination face, said terminal subassembly comprising a housing means having said plurality of terminals secured therein arranged in at least one row with the conductor-receiving slots thereof disposed adjacent said termination face and aligned normally to a cable-receiving side thereof spaced equally to said signal conductor means of said transmission cable means and further comprising a ground bus secured therein along the other side thereof having conductor-receiving grooves therein aligned normally to said cable-receiving side and aligned with and adapted to receive thereinto said ground conductor means in interference fit therein;

placing the prepared end portion of said transmission cable means along said termination face of said terminal subassembly from said cable-receiving side thereof with said signal and ground conductor means arrayed in parallel coplanar relationship aligned with and above resepctive said conductor-receiving slots and grooves;

wiping ends of said signal conductor means into respective conductor-receiving slots of respective terminals in interference fit therein and wiping ends of said ground conductor means into respective conductor-receiving grooves of said ground bus in interference fit therein adjacent said termination face;

welding said signal conductor means to said respective terminals and welding said ground conductor means to said ground bus; and securing a dielectric means to said housing means to clamp an end of the insulated portion of said transmission cable means in said connector, covering the terminations and securing the terminals and ground bus in said housing means, with said transmission cable means extending outwardly from said cable-receiving side thereof.

16. A method as set forth in claim 15 comprising the additional steps of bending said transmission cable means over a top surface of said dielectric means to extend from the other side of said connector at right angles thereto and securing to said housing means a retaining means over said transmission cable means providing strain relief therefor.

17. A method as set forth in claim 15 comprising the additional step of programming said connector by selecting at least one signal conductor means to be terminated to said ground bus and welding said selected signal conductor means to said ground bus and to a respective said terminal forming a ground terminal.

18. A method as set forth in claim 15 wherein said welding is laser welding.

* * * * *